United States Patent [19]

Röck

[11] 4,359,802

[45] Nov. 23, 1982

[54] ADJUSTABLE HINGE

[75] Inventor: Erich Röck, Küferstrasse, Fed. Rep. of Germany

[73] Assignee: Julius Blum Gesellschaft m.b.H., Höchst, Austria

[21] Appl. No.: 154,136

[22] Filed: May 29, 1980

[30] Foreign Application Priority Data

Jun. 5, 1979 [AT] Austria ..... 4029/79

[51] Int. Cl.[3] ..... E05D 7/04

[52] U.S. Cl. ..... 16/238; 16/246; 16/251

[58] Field of Search ..... 16/129–133, 16/236, 237, 238, 241, 246, 251

[56] References Cited

U.S. PATENT DOCUMENTS

| | | | |
|---|---|---|---|
| 3,890,670 | 6/1975 | Sewing et al. | 16/129 |
| 3,969,787 | 7/1976 | Rock et al. | 16/129 |
| 4,045,841 | 9/1977 | Rock et al. | 16/129 |
| 4,227,284 | 10/1980 | Zernig | 16/129 |

*Primary Examiner*—Werner H. Schroeder
*Assistant Examiner*—Andrew M. Falik
*Attorney, Agent, or Firm*—Wenderoth, Lind & Ponack

[57] ABSTRACT

A hinge includes a hinge arm which is adjustable in three directions. An intermediate member is situated between the hinge arm and a mounting plate. One screw clamps the intermediate member to the mounting plate, another screw clamps the hinge arm to the intermediate member, and a third screw acts between the intermediate member and the mounting plate providing an adjustment of the hinge arm in a plane vertical to the mounting plate.

10 Claims, 2 Drawing Figures

Fig. 1
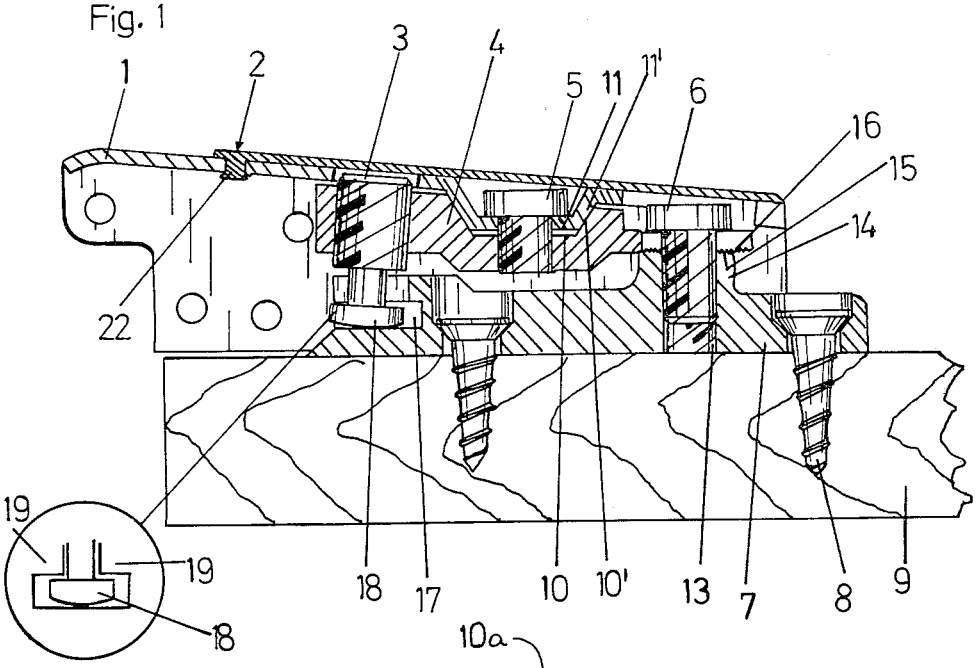
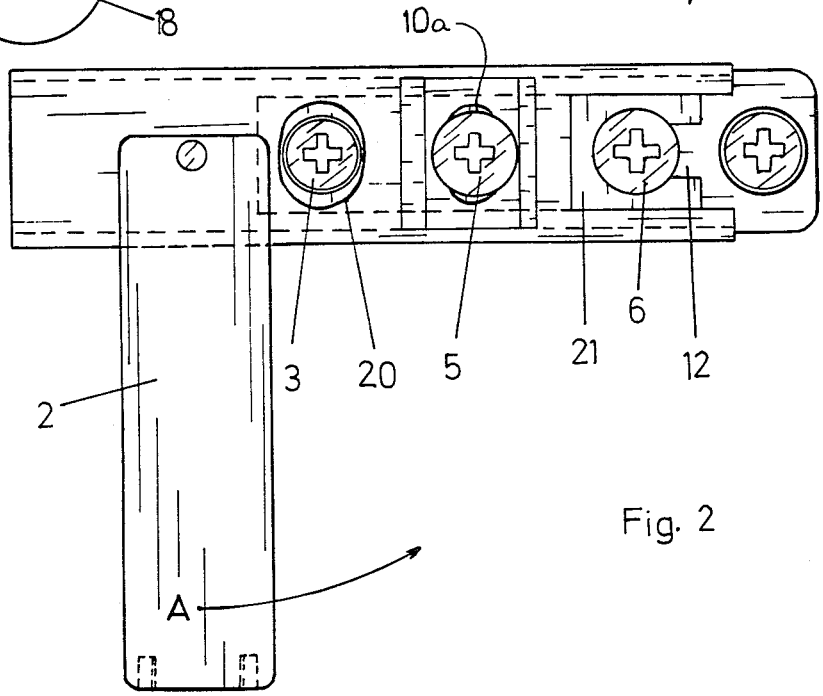
Fig. 2

ADJUSTABLE HINGE

BACKGROUND OF THE INVENTION

1. Field of the Invention

The present invention relates to an adjustable hinge, particularly for furniture doors, comprising a hinge arm linked to a second hinge member, e.g. a dowel housing, by means of hinge links or the like and being carried by an intermediate member retained on a mounting plate adapted to be fastened to a furniture part.

2. Description of the Prior Art

Hinges of the above-described kind are frequently used in modern furniture construction, and they should generally fulfill a number of requirements. First, it should be easy to put the door on its hinges, i.e. it should be easy to fasten it to the body of the piece of furniture. Second, when the door wing has been placed on its hinges, various corrections with respect to its position should be possible so that any inaccuracies resulting from the drilling of fastening holes can be overcome.

Basically, adjustments of the hinge in the direction of the depth of the piece of furniture and in the direction of the breadth of the door joint is required. An adjustment in the direction of the height of the piece is also desirable.

SUMMARY OF THE INVENTION

It is the object of the present invention to provide a hinge allowing the three afore-mentioned possibilities of adjustment. Moreover, the hinge arm is adapted to be easily mounted on the mounting plate, when the door is put on its hinges, and the hinge members mounted on the furniture side wall are of highly compact construction providing accurate guiding of the hinge arm during adjustment.

According to the present invention, this object is achieved by providing an intermediate member with a slot which is open at its rear end, a clamping screw, which is mounted on the mounting plate, projecting through such slot, and by mounting an adjusting screw in the intermediate member, the head of such adjusting screw extending into a recess in the mounting plate, such recess being of T-shaped cross-section and open forwardly.

It is preferably provided that the inside width of the hinge arm, which has a U-shaped configuration is greater than the breadth of the intermediate member, thereby obtaining a hinge covered on all sides.

It is further provided that the intermediate member has a guiding recess extending transversely to the longitudinal direction of the hinge arm and a projection of the hinge arm extending into such guiding recess. Hence, the hinge arm is secured against being distorted by the weight of the door.

The positioning of the hinge arm is facilitated by adapting the side walls of both the guiding recess and the projection to converge towards the mounting plate and to rest against one another when the hinge arm is in the mounted position.

It is preferably provided that a clamping screw retaining the hinge arm is arranged on the bottom of the guiding recess, thereby avoiding that hinge members project laterally, when the hinge is in the mounted position. The hinge can also be provided with a cover plate, which covers the screw.

A further feature provides that the hinge arm at its rear end above the clamping screw is provided with an aperture. The clamping screw and the aperture can also be covered by the cover plate, which is preferably pivotally mounted on the hinge arm by means of a pin.

A further feature provides that the hinge arm has a hole arranged above the adjusting screw, such hole preferably being a transversely extending slot.

By turning the cover plate, all screws are accessible for adjusting and fixing the hinge arm.

BRIEF DESCRIPTION OF THE DRAWINGS

In the following an embodiment of the present invention will be described in more detail with reference to the accompanying drawings without being limited thereto, and wherein:

FIG. 1 is a longitudinal section through a hinge according to the invention; and FIG. 2 is a plan view thereof.

In the drawings, the hinge member on the side of the door, the dowel casing and the hinge link are not shown as they are not the subject of the present invention and, are well known in the art.

DESCRIPTION OF THE PREFERRED EMBODIMENT

The hinge in accordance with the present invention has a mounting plate 7 fastened to a furniture side wall 9 by means of fastening screws 8. Other fastening means, e.g. dowels, naturally also can be used.

The hinge arm 1 is not directly fastened to the mounting plate 7 but is retained on an intermediate member 4 by means of a hinge arm clamping screw 5. The intermediate member 4 is provided with a recess 10 having converging side walls 10'. A projection 11 of the hinge arm 1 having side walls 11' extends into recess 10, side walls 11' being parallel to side walls 10'. The clamping screw 5 extends through a transversely extending guiding hole **10*a* in projection 11 and is threaded into a female thread of the intermediate member 4. In this embodiment, the hinge arm 1 is torsion-resistantly mounted on the intermediate member 4**.

The intermediate member 4 has an adjusting screw 3 at its front end. A slot 12, which is open at its rear end, is provided at the rear end of the intermediate member.

An intermediate member clamping screw 6 extends through open slot 12, the clamping screw 6 being mounted in a female thread 13 of the mounting plate 7. Mounting plate 7 is preferably provided with a base 14 in the region of the clamping screw 6. Base 14 is provided with indentations 15 at its upper end, and the intermediate member 4 has also indentations 16 on both sides of the slot 12.

The mounting plate 7 has a recess 17 on its front side, such recess being of T-shaped cross-section and open in the forward direction.

When putting the door on its hinges, the intermediate member 4 is fastened to the hinge arm 1 by means of the clamping screw 5. The hinge arm 1 is fastened to the dowel casing, which is inserted in the door, by means of the hinge links.

When being mounted, the hinge arm 1 with the intermediate member 4 is pushed onto the mounting plate 7 in such a manner that the clamping screw 6, which is screwed into the mounting plate 7, extends through the slot 12 with the intermediate member 4 being positioned underneath the head of the clamping screw 6. At the front end, a head 18 of the adjusting screw 3 is pushed into the recess 17, head 18 resting against projections 19 delimited by recess 17.

Hence, the door is retained on the furniture side wall 9 simply by pushing the hinge arm onto the mounting plate.

The adjustment of the breadth of the door joint is effected by turning the adjusting screw 3.

When the hinge arm 1 is in the direction of the desired position in the depth of the piece of furniture, the clamping screw 6 is fastened, and the hinge arm 1 is fixed on the mounting plate 7. Unintentional displacement is eliminated by the indentations 15,16.

When the hinge arm 1 is to be adjusted in the direction of the height of the piece of furniture, the clamping screw 5 is loosened, and the hinge arm 1 can then be moved due to guiding hole 10*a*. When the hinge arm is in the desired position, the clamping screw 5 is fastened, and the hinge arm 1 is adjusted and secured.

In order to provide an access for tools, the hinge arm has a slot 20 extending transversely of its longitudinal center plane and an aperture 21 arranged at its rear end.

The hinge arm 1 further comprises a cover plate 2 pivotally mounted on the hinge arm 1 by means of pin 22. When the hinge arm has been finally adjusted and fixed, the cover plate is turned to the direction of arrow A in FIG. 2 and then covers all of the apertures and adjusting screws.

What is claimed is:

1. An adjustable hinge for use in mounting a door to an article of furniture, said hinge comprising:

a mounting plate adapted to be fixed to a side wall of an article of furniture, said mounting plate having in a forward end thereof a longitudinally extending recess open at said forward end of said mounting plate;

an intermediate member having at a rear end thereof a longitudinally extending slot open at said rear end and at a forward end thereof an internally threaded opening;

an adjusting screw threaded into said internally threaded opening, said adjusting screw having a head slidably extending into said recess in said forward end of said mounting plate;

an intermediate member clamping screw extending through said slot in said rear end of said intermediate member and threaded into said mounting plate;

a hinge arm having a U-shaped transverse cross-sectional configuration and being positioned over said intermediate member, said hinge arm having therein a transversely extending guiding hole;

a hinge arm clamping screw extending through said guiding hole and being threaded into said intermediate member;

said hinge arm being adjustable transversely with respect to said intermediate member through the length of said guiding hole;

said intermediate member and said hinge arm being adjustable longitudinally with respect to said mounting plate along said slot in said rear end of said intermediate member; and said intermediate member and said hinge arm being adjustable toward and away from said mounting plate by rotation of said adjusting screw.

2. A hinge as claimed in claim 1, wherein said recess in said forward end of said mounting plate is T-shaped in transverse cross section.

3. A hinge as claimed in claim 1, wherein the transverse width of said hinge arm is greater than the transverse width of said intermediate member.

4. A hinge as claimed in claim 1, wherein said intermediate member has therein a transversely extending recess, said hinge arm has therein a transversely extending projection fitting into said transversely extending recess, and said guiding hole is located in said projection.

5. A hinge as claimed in claim 4, wherein said hinge arm clamping screw is threaded into the bottom of said recess in said intermediate member.

6. A hinge as claimed in claim 4, wherein side walls of said recess and of said projection converge toward each other and are in contact.

7. A hinge as claimed in claim 1, wherein said hinge arm has therein an aperature at a position to expose the head of said intermediate member clamping screw.

8. A hinge as claimed in claim 1, wherein said hinge arm has therein a transversely extending opening at a position to expose the head of said adjusting screw.

9. A hinge as claimed in claim 1, further comprising a cover plate mounted on said hinge arm.

10. A hinge as claimed in claim 9, wherein said cover plate is pivotally mounted on said hinge arm by means of a pin.

* * * * *